US006711844B2

(12) United States Patent
Rumfelt

(10) Patent No.: US 6,711,844 B2
(45) Date of Patent: Mar. 30, 2004

(54) FIREARM LOCKING SYSTEM AND METHOD FOR PREVENTING ROTATION OF A CYLINDER

(76) Inventor: Albert Eugene Rumfelt, 7827 H. 14-16 N., Gillette, WY (US) 82716

( * ) Notice: Subject to any disclaimer, the term of this patent is extended or adjusted under 35 U.S.C. 154(b) by 0 days.

(21) Appl. No.: 10/145,139

(22) Filed: May 15, 2002

(65) Prior Publication Data

US 2002/0174589 A1 Nov. 28, 2002

Related U.S. Application Data

(60) Provisional application No. 60/293,200, filed on May 25, 2001.

(51) Int. Cl.[7] ..... F41A 17/00
(52) U.S. Cl. ..... 42/70.11; 42/84
(58) Field of Search ..... 42/70.11, 66, 84

(56) References Cited

U.S. PATENT DOCUMENTS 3,939,679 A * 2/1976 Barker et al. ..... 70/277
4,092,794 A * 6/1978 Moren ..... 42/70.11
5,052,142 A * 10/1991 Mikus ..... 42/70.11
5,081,779 A * 1/1992 Pack ..... 42/70.11
5,303,495 A * 4/1994 Harthcock ..... 42/84
5,331,759 A * 7/1994 Marceau et al. ..... 42/70.11
5,347,739 A * 9/1994 Stuart ..... 42/70.11
5,392,552 A * 2/1995 McCarthy et al. ..... 42/70.07
5,394,635 A * 3/1995 Stuart ..... 42/70.11
5,417,000 A * 5/1995 Chen ..... 42/70.06
5,621,996 A * 4/1997 Mowl, Jr. ..... 42/70.07
5,704,151 A * 1/1998 West et al. ..... 42/70.07
5,860,241 A * 1/1999 Waters ..... 42/70.11
6,041,536 A * 3/2000 Samuels et al. ..... 42/70.11
6,154,995 A * 12/2000 Lenoir et al. ..... 42/70.07
6,170,186 B1 * 1/2001 Reed ..... 42/70.11
6,283,034 B1 * 9/2001 Miles, Jr. ..... 102/430
6,293,039 B1 * 9/2001 Fuchs ..... 42/70.11
6,314,671 B1 * 11/2001 Gering ..... 42/70.11
6,408,556 B1 * 6/2002 Achee et al. ..... 42/70.11

* cited by examiner

*Primary Examiner*—Michael J. Carone
*Assistant Examiner*—Denise J. Buckley
(74) *Attorney, Agent, or Firm*—Hogan & Hartson L.L.P.

(57) ABSTRACT

The invention describes a firearm locking system and method for preventing rotation of a cylinder. In particular, the firearm locking system and method of the present invention provides a cylinder locking unit for a firearm adaptable to a firearm chamber, the cylinder locking unit including a receiver, an electric actuator, and a locking device extendible from the firearm chamber for preventing discharge of the firearm, the locking device extending upon activation of the electric actuator.

19 Claims, 4 Drawing Sheets

FIREARM LOCKING SYSTEM AND METHOD FOR PREVENTING ROTATION OF A CYLINDER

CROSS-REFERENCE TO RELATED APPLICATIONS

This application claims priority from U.S. Provisional Patent Application No. 60/293,200, filed May 25, 2001, entitled "ELECTRONIC OR MANUAL OPERATED FIREARMS SAFETY LOCKING SYSTEM," the entirety of which is herein incorporated by reference.

BACKGROUND OF THE INVENTION

1. Field of the Invention

The present invention relates to a firearm locking system and method, and more particularly, to a firearm locking system and method for preventing rotation of a cylinder.

2. Discussion of the Related Art

Throughout history, firearms have been used for protection and recreation. Many private citizens, fearing crime, have chosen to arm themselves in order to provide a feeling of security. Placing firearms in the home presents a number of potential problems, including the possibility of a child gaining access to the firearm or the possibility of an intruder gaining access to the firearm and using it against the homeowner. One option is to keep the firearm unloaded. However, an unloaded firearm will be ineffective against a surprise intruder.

A number of conventional solutions have been developed that permit the firearm to be loaded and ready for use, while preventing injury to children and use of the firearm by unauthorized users. For example, key locks have been developed which restrict operation of the gun triggers. These types of locks require a key for operation. Key locks, however, are often complex and cumbersome, presenting a significant obstacle to accessing the firearm quickly when necessary, such as to protect or defend against an intruder. Moreover, tampering with such locks may lead to accidental discharge of the firearm.

Firearm storage devices, such as gun cabinets, effectively secure firearms but do so at the expense of accessibility. These devices may also be quite expensive, requiring the consumer to choose between cost and safety.

More recent systems employ a magnetically actuable safety apparatus, which interacts with a magnet ring worn by the user, resulting in the enabling or disabling of the lock. Typically, such devices are extremely sensitive to ring positioning, leading to unreliable operation. In addition, the user must be in possession of the magnetic ring in order to disable the lock.

Thus, in view of the inadequacies of conventional firearm locking devices, there is a substantial need for an economical firearm locking system that can secure a firearm without sacrificing its availability for immediate use.

SUMMARY OF THE INVENTION

Accordingly, the present invention is directed to a firearm locking system and method for preventing rotation of a cylinder that solves the problems in conventional firearm locking systems as described above.

The invention provides a system and method for allowing a user to remotely disable and enable a firearm locking mechanism. Thus, a user of the locking system and method in accordance with the invention need not be in physical possession of the firearm in order to disable and enable the locking mechanism. This allows a user to quickly disable and use the firearm when needed.

Therefore, one aspect of the invention is to provide a locking system and method for a firearm that can be remotely disabled and enabled.

Another aspect of the invention is to provide a firearm locking system and method that includes a transmitter device for sending a locking enabling and disabling signal to a self contained locking system mounted on a firearm.

In accordance with these and other aspects, the invention provides a cylinder locking unit for a firearm adaptable to a firearm chamber, the cylinder locking unit including a receiver for generating a control signal upon receipt of a request signal; an electric actuator activated by the control signal received from the receiver; and a locking device extendible from the firearm chamber for preventing discharge of the firearm, the locking device extending upon activation of the electric actuator.

In a further embodiment, the invention provides a method for locking a cylinder-type firearm, which includes placing a cylinder locking unit in a firearm chamber; generating a control signal upon receipt of a request signal; activating an electric actuator upon receipt of a control signal; and extending a locking device from the firearm chamber to prevent discharge of a firearm, the locking device extending upon activation of the electric actuator.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to embodiments of the present invention, examples of which are illustrated in the accompanying drawings.

Figure 1:
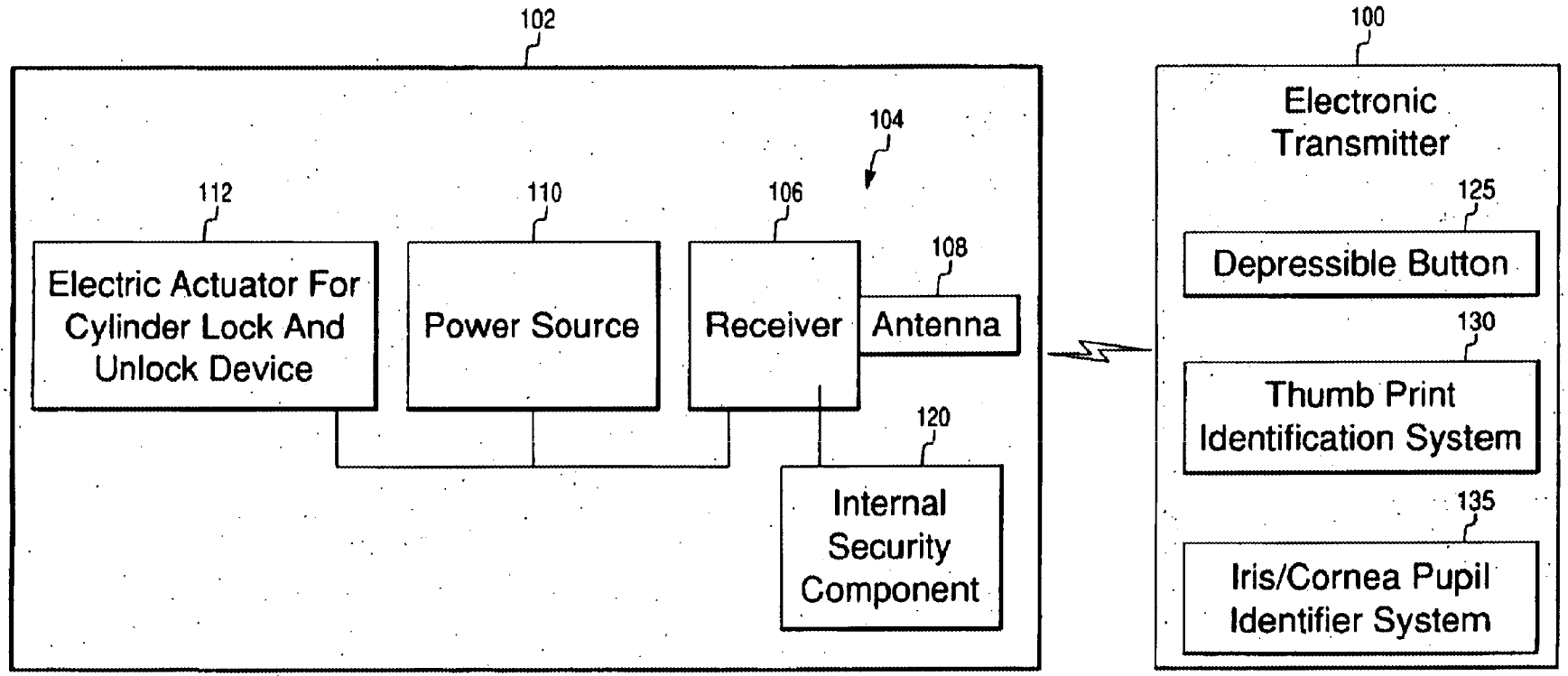
FIG. 1 is a block diagram of a firearm locking system according to an embodiment of the invention.

FIG. 1 shows a block diagram of a firearm locking system in accordance with an embodiment of the invention. In particular, FIG. 1 shows an electronic transmitter 100 in communication with a cylinder locking unit 102. The cylinder locking unit 102 includes a power source 110 coupled to an electric actuator 112 and a receiver unit 104. The electric actuator 112 and receiver unit 104 are also coupled to each other. The receiver unit 104 includes a receiver 106 and antenna 108. Each of these elements will be discussed in turn.

Turning to the electronic transmitter 100, the electronic transmitter 100 may be permanent or portable. An example of a portable electronic transmitter includes a remote controller. The electronic transmitter 100 is capable of receiving input from a user. For example, the electronic transmitter 100 may include a depressible button 125 for sending a signal. In addition, the electronic transmitter 100 may include various security features, such as a thumb print identification system 130 or an iris/cornea pupil identifier system 135, which only allow authorized users to operate the electronic transmitter 100. The electronic transmitter 100 may be used to lock and unlock the firearm. The electronic transmitter 100 may be any one of standard off the shelf components capable of transmitting radio frequency transmissions. The electronic transmitter 100 sends a signal to the cylinder locking device 102 in order to operate the device 102.

The cylinder locking unit 102 includes the receiver unit 104, the power source 110, and the electric actuator 112. The electric actuator 112 includes a locking device. In accordance with an embodiment of the present invention, the cylinder locking unit 102 may be located in any one of the chambers of the cylinder of a firearm. In operation, a user initiates a request signal, which is transmitted from the electronic transmitter 100 to the receiver unit 104. Specifically, the antenna 108 of the receiver unit 104 receives the request signal sent from the electronic transmitter 100. The antenna 108 may be any one of standard off the shelf components capable of receiving radio frequency transmissions. The receiver 106 which receives the request signal may be a signal generator. The receiver 106 may be a small receiver such as a micro-receiver. In an embodiment of the invention, the receiver 106 includes an internal security component 120. An example of the internal security component 120 includes the ability of the receiver 106 to self-destruct (e.g., by burning its circuits) upon disassembly. After receiving the request signal, the receiver 106 generates a control signal that is sent to the electric actuator 112.

The electric actuator 112 may include a relay which completes the circuit when the control signal is received. Once the circuit is completed, current is delivered to the electric actuator 112.

The power source 110 may be any AC or DC power supply, such as dry cell batteries providing DC current. The power source 110 provides power to both the receiver unit 106 and the electric actuator 112.

The electric actuator 112 may be one of a variety of actuators, such as a solenoid or, alternatively, a motor. The electric actuator 112 may be configured to include a locking device. One type of locking mechanism in accordance with the invention is a plunger type device which is described in greater detail below. In accordance with one embodiment of the invention, the electric actuator 112 may be a solenoid held in position by at least one permanent magnet. The solenoid may be capable of moving the locking device (e.g. plunger) into a locked or unlocked position upon activation. For example, if the firearm locking system in accordance with the invention is in an unlocked position, activation of the electric actuator 112 will extend the locking device from the front of a cylinder chamber into the barrel (or forcing cone) of the firearm, thereby preventing rotation of the cylinder in either direction. Thus, the cylinder cannot be rotated or advance to bring a live cartridge into the firing position, and the firearm is locked. Alternatively, if the firearm locking system in accordance with the present invention is in a locked position, and the locking device is therefore extended into the barrel of the firearm, activation of the electric actuator 112 retracts the locking device out of the rear of the barrel (or forcing cone) and back into the front of the cylinder chamber, thereby permitting rotation of the cylinder. This unlocks the firearm and allows it to be operated.

The cylinder locking unit 102 may also be operated manually with the proper tool inserted from the muzzle end of the firearm, thereby overriding the electric actuator 112.

Figure 2:
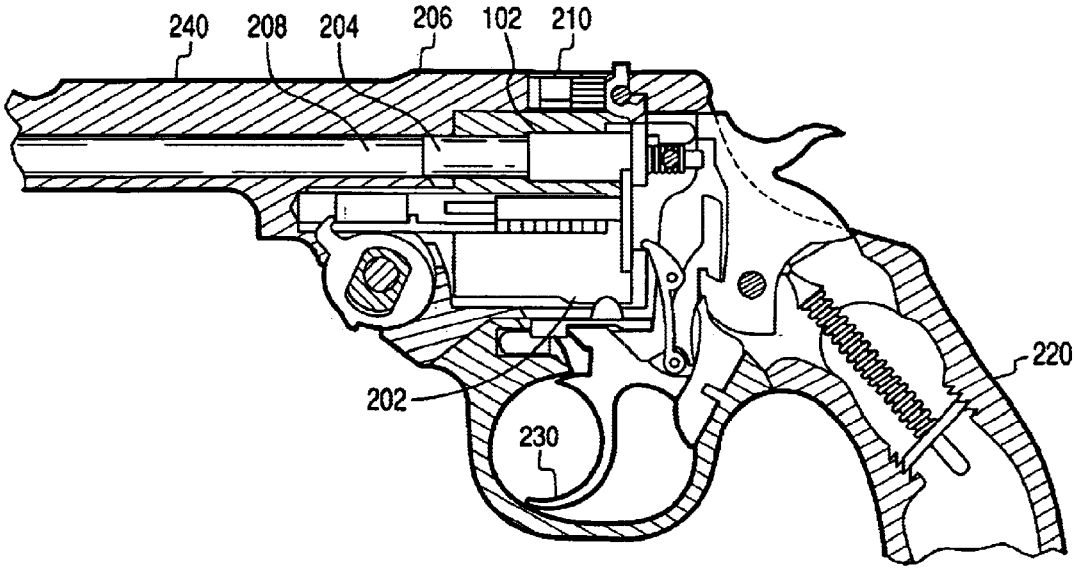
FIG. 2 is a side view of a firearm showing the locked position of a firearm locking system according to an embodiment of the invention.
Figure 3:
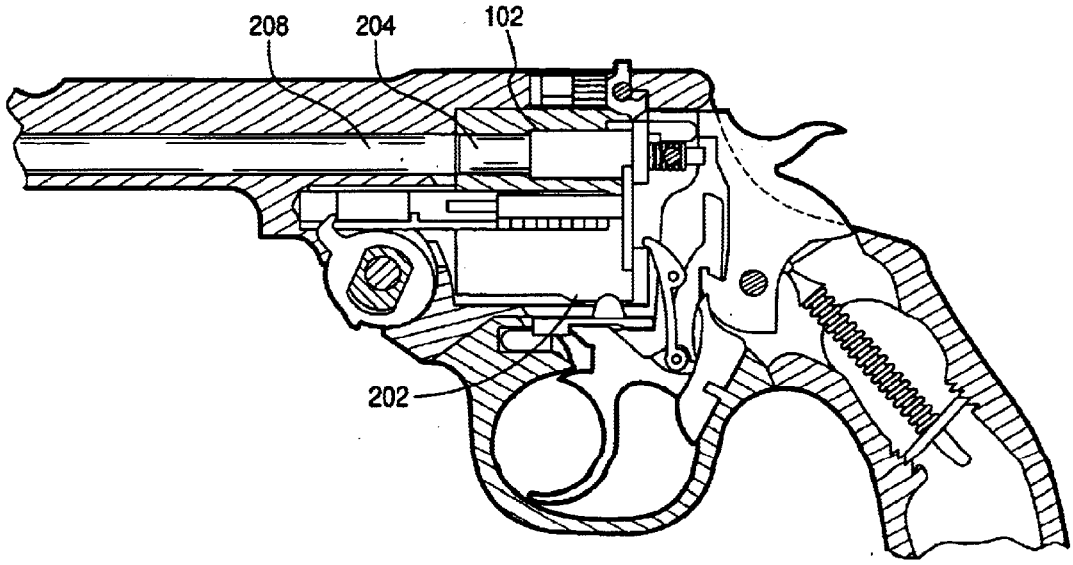
FIG. 3 is a side view of a firearm showing the unlocked position of a firearm locking system according to an embodiment of the invention.

FIGS. 2 and 3 illustrate side views of a firearm with the firearm locking system in the locked and unlocked positions, respectively, in accordance with an embodiment of the invention. Each will be discussed in turn.

FIG. 2 illustrates a side view of a revolver and, in particular, a revolver locked by the firearm locking system in accordance with an embodiment of the invention. It should be understood that the firearm locking system in accordance with the invention may be used on any hand or shoulder held firearms having a cylinder type mechanism. As shown in FIG. 2, the revolver includes a body 210 that includes a grip 220, a trigger 230 and a barrel 240. A cylinder 202 is mounted on the body 210. The cylinder includes a plurality of chambers (not shown) capable of carrying ammunition. The cylinder locking unit 102 is in a chamber of the cylinder 202 of the firearm. The cylinder locking unit 102 includes a locking device 204.

The locking device 204 is in the extended position, extending from the front of a cylinder chamber 206 into the rear of the barrel or forcing cone 208. The extended locking device 204 may be a plunger-type structure that extends into the rear of the barrel or forcing cone 208. In this extended position, the firearm locking system forms a positive lock, preventing the cylinder 202 from rotating in either direction and thus disabling the firearm.

FIG. 3 shows the firearm locking system in accordance with an embodiment of the invention where the locking device 204 is in an unlocked position allowing operation of the firearm. In FIG. 3, the cylinder locking unit 102 is positioned in the cylinder 202 and the locking device 204 is in a retracted position, in the front position of the cylinder chamber 206. The retracted locking device 204 includes a plunger. In this retracted position, the locking device 204 does not extend into the rear of the barrel or forcing cone, thereby permitting rotation of the cylinder and the firearm is capable of firing.

Figure 4A:
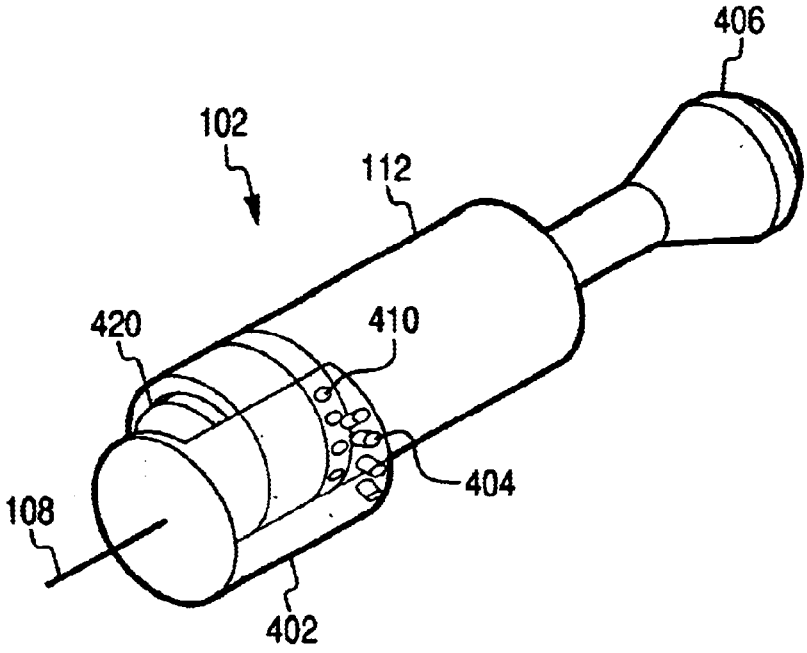
FIGS. 4*a* and 4*b* are side views of a firearm locking mechanism according to an embodiment of the invention.

FIG. 4*a* is a general view of the cylinder locking unit 102 in accordance with an embodiment of the invention. The cylinder locking unit 102 includes the electric actuator 112. The electric actuator 112 includes a plunger 406 that is capable of extending into the rear of the barrel or forcing cone 208 of the firearm, thus preventing operation of the firearm.

In FIG. 4*a*, the electric actuator has source connector openings disposed along its outer wall surface. A power source 420 abuts one end of the electric actuator. In accordance with the present invention, the power storage rack 402 may be connected to the electric actuator 112 by mating the power source connector pins 404, preferably four pins, into power source connector openings 410 disposed on the outer wall surface of the actuator 112. In an alternate embodiment, the power storage rack 402 may be connected to the electric actuator 112 by solder joints. The attachment of the power storage rack 402 to the electric actuator 112 forms a seal over the power source 420. The antenna 108 is also mounted on the power storage rack 402. The electric actuator 112 is connected to the plunger locking device 406.

Figure 4B:
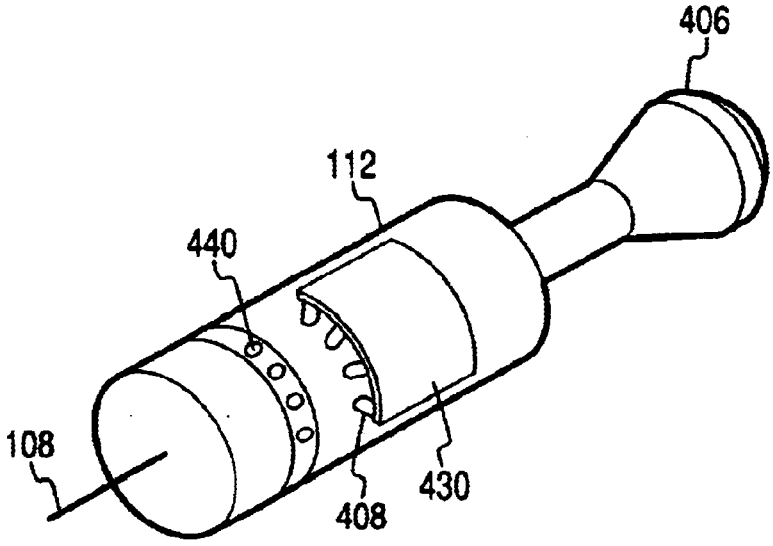

FIG. 4*b* shows a general view of the cylinder locking unit 102 in accordance with an embodiment of the invention. Like FIG. 4*a*, FIG. 4*b* shows the actuator having a plunger 406. FIG. 4*b* also shows receiver connector openings 440 disposed on the outer wall surface of the actuator 112. A receiver 430 having receiver connecting pins 408 may be coupled to the actuator 112 by mating the receiver connector openings 440 with the receiver connecting pins 408. In an alternate embodiment, the receiver 430 may be connected to the electric actuator 112 by solder joints. FIG. 4*b* also shows an antenna 108 mounted on the end of, and connected to, the electric actuator 112.

Thus, in operation, a request signal is transmitted from the electronic transmitter 100 to the antenna 108. The receiver 430 receives the transmitted signal and generates a control signal that completes a circuit engaging the electric actuator 112. The electric actuator 112 then engages the plunger 406, moving the plunger.

Figure 5:
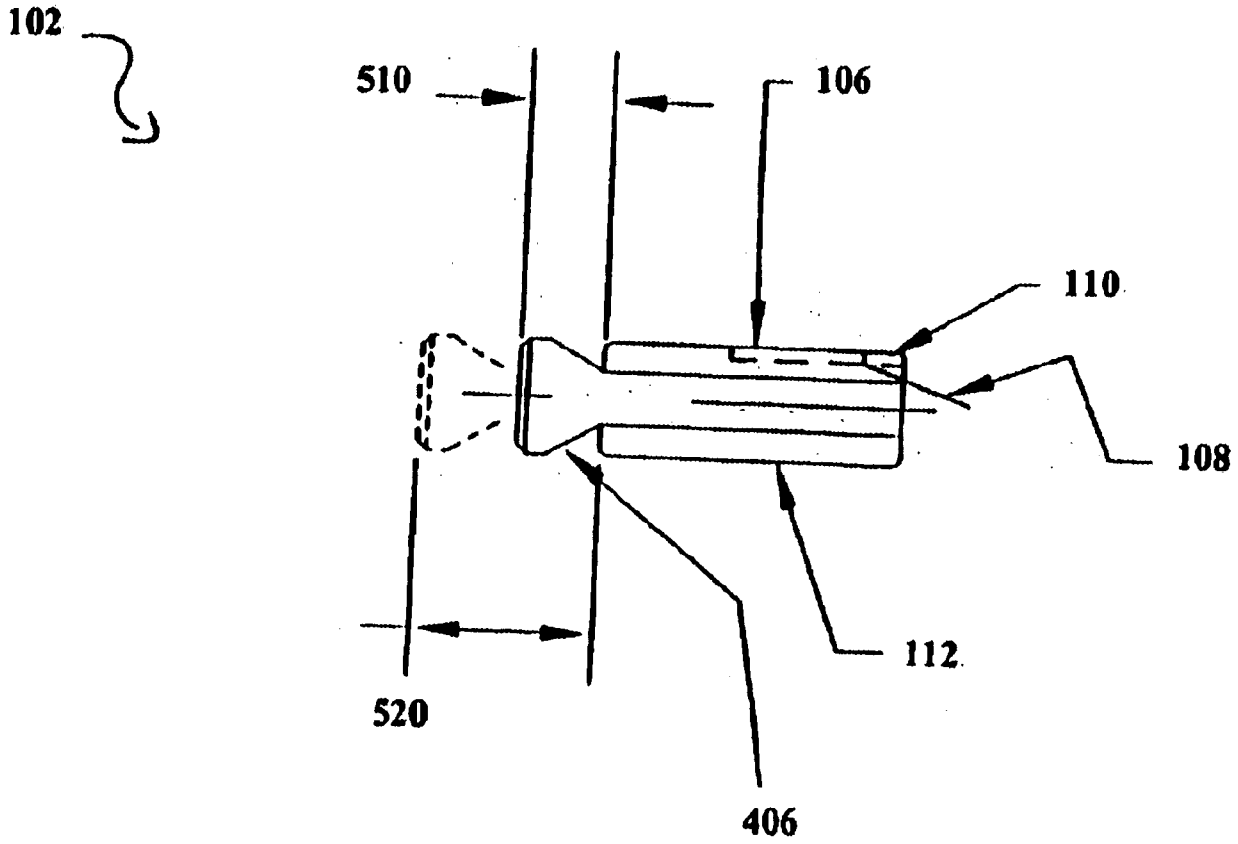
FIG. 5 is a diagram illustrating a position shift from locked to unlocked position of a firearm locking system according to an embodiment of the invention.

FIG. 5 shows a cross sectional view of the cylinder locking unit 102 in accordance with an embodiment of the invention. FIG. 5 shows the electric actuator 112 having the receiver 106, power source 110, and antenna 108 mounted upon its surface. The electric actuator 112 includes a plunger 406 capable of linear movement. In FIG. 5, the plunger 406 is in the first position 510 before the cylinder locking unit is engaged. Thus, in this position, the firearm is operable. When the cylinder locking unit 102 is engaged, the plunger 406 moves from the first position 510 to a second position 520. Thus, the plunger 406 has moved linearly in a direction away from the body of the electric actuator 112. Therefore, in position 520, the plunger 406 extends to the rear of the barrel or forcing cone 208, preventing operation of the firearm.

FIG. 5 shows the cylinder locking unit 102 in the unlocked position. Specifically, FIG. 5 illustrates the antenna 108, receiver 106, power source 110, electric actuator 112, housing for the cylinder locking unit (as shown in FIGS. 2 and 3), and plunger 406. The plunger locking device 406 is in the retracted or unlocked position. In accordance with the present invention, the housing surrounds the antenna 108, power source 110, receiver 106, and electric actuator 112. An example of the housing includes a round cylinder which is sized in accordance with the caliber of the firearm. In an embodiment of the present invention, the housing may be made of a metal of composite material. The base of the housing may have a rim (as shown in FIGS. 2 and 3) with an opening for the antenna 108.

It will be apparent to those skilled in the art that various modifications and variations can be made in the firearm locking system of the present invention without departing from the spirit or scope of the invention. Thus, it is intended that the present invention cover the modifications and variations of this invention provided that they come within the scope of any claims and their equivalents.

I claim:

1. A cylinder locking unit for a firearm adaptable to a firearm chamber, comprising:

a receiver for generating a control signal upon receipt of a request signal, the receiver including a sensing antenna;

an electric actuator activated by the control signal received from the receiver; and a locking device extendible from the firearm chamber for preventing discharge of the firearm, the locking device extending upon activation of the electric actuator.

2. The cylinder locking unit according to claim 1, further including a power source.

3. The cylinder locking unit according to claim 1, wherein the receiver includes an internal security component.

4. The cylinder locking unit according to claim 1, wherein the receiver receives the request signal from an electronic transmitter.

5. The cylinder locking unit according to claim 1, wherein the electric actuator includes a solenoid.

6. The cylinder locking unit according to claim 1, wherein the locking device includes a plunger.

7. The cylinder locking unit according to claim 1, wherein the locking device extends into a forcing cone upon activation of the electric actuator.

8. The cylinder locking unit according to claim 6, wherein the locking device retracts from the forcing cone upon deactivation of the electric actuator.

9. The cylinder locking unit according to claim 3, wherein the electronic transmitter includes a thumb print identification system.

10. The cylinder locking unit according to claim 3, wherein the electronic transmitter includes an iris/cornea pupil identification system.

11. The cylinder locking unit according to claim 3, wherein the electronic transmitter includes a depressible button.

12. The cylinder locking unit according to claim 2, further including a housing which surrounds the power source, the receiver, and the electric actuator, the housing sized in accordance with the firearm's caliber.

13. A method for locking a cylinder-type firearm, comprising:

placing a cylinder locking unit in a firearm chamber;

generating a control signal upon receipt of a request signal, the control signal generated by a receiver having a sensing antenna;

activating an electric actuator upon receipt of a control signal; and extending a locking device from the firearm chamber to prevent discharge of a firearm, the locking device extending upon activation of the electric actuator.

14. The method according to claim 13, wherein the control signal may be generated by a receiver.

15. The method according to claim 13, wherein the request signal may be generated by an electronic transmitter.

16. The method according to claim 13, wherein the electric actuator includes a solenoid.

17. The method according to claim 13, wherein the locking device extends into a forcing cone.

18. The method according to claim 13, wherein the locking device retracts from the forcing cone upon deactivation of the electric actuator.

19. A cylinder locking unit for a firearm adaptable to a firearm chamber, comprising:

a receiver for generating a control signal upon receipt of a request signal;

an electric actuator activated by the control signal received from the receiver;

a locking device extendible from the firearm chamber for preventing discharge of the firearm, the locking device extending upon activation of the electric actuator; and a housing which surrounds the power source, the receiver, and the electric actuator, the housing sized in accordance with the firearm's caliber.

* * * * *